United States Patent [19]

Ishida

[11] 4,198,940

[45] Apr. 22, 1980

[54] SPLIT OPERATION TYPE MULTI-CYLINDER INTERNAL COMBUSTION ENGINE

[75] Inventor: Yasuhiko Ishida, Mishima, Japan

[73] Assignee: Toyota Jidosha Kogyo Kabushiki Kaisha, Toyota, Japan

[21] Appl. No.: 954,847

[22] Filed: Oct. 26, 1978

[30] Foreign Application Priority Data

Jul. 6, 1978 [JP] Japan ..... 53-81421

[51] Int. Cl.[2] ..... F02M 25/06; F02M 13/04; F02D 9/00

[52] U.S. Cl. ..... 123/119 A; 123/198 F

[58] Field of Search ..... 123/119 A, 198 F

[56] References Cited

U.S. PATENT DOCUMENTS

| | | | |
|---|---|---|---|
| 3,776,207 | 12/1973 | Simko | 123/119 A |
| 3,779,013 | 12/1973 | Faber et al. | 123/119 A |
| 4,019,479 | 4/1977 | Garabedian | 123/198 F |
| 4,024,708 | 5/1977 | Takemoto | 123/119 A |
| 4,041,910 | 8/1977 | Houseman | 123/119 A |
| 4,068,637 | 1/1978 | Takamiya | 123/119 A |
| 4,106,471 | 8/1978 | Narajima et al. | 123/198 F |
| 4,131,095 | 12/1978 | Ouchi | 123/119 A |
| 4,143,635 | 3/1979 | Iizuka et al. | 123/119 A |

*Primary Examiner*—Wendell E. Burns
*Attorney, Agent, or Firm*—Kenyon & Kenyon

[57] ABSTRACT

Disclosed is a split operation type internal combustion engine having a plurality of cylinders which are divided into a first cylinder group and a second cylinder group. The cylinders of the first cylinder group are connected to a first common intake manifold equipped with a first carburetor, and the cylinders of the second cylinder group are connected to a second common intake manifold equipped with a second carburetor. The second intake manifold is connected to the exhaust manifold via a bypass passage, and an exhaust valve is arranged in the bypass passage. A first gear actuated by the accelerator pedal is operatively connected to the first throttle valve of the first carburetor and intermittently engaged with a second gear connected to the second throttle valve of the second carburetor. The firing operation is always carried out in the first cylinder group. When the level of the vacuum produced in the first intake manifold is greater than a predetermined level, the second throttle valve remains closed, and the exhaust valve remains fully opened. At this time the exhaust gas is fed into the second cylinder group. When the level of the vacuum produced in the first intake manifold is reduced below the predetermined level, the first gear comes into engagement with the second gear for opening the second throttle valve and, at the same time, the exhaust valve is closed so that the firing operation is started in the second cylinder group.

13 Claims, 7 Drawing Figures

SPLIT OPERATION TYPE MULTI-CYLINDER INTERNAL COMBUSTION ENGINE

DESCRIPTION OF THE INVENTION

The present invention relates to a split operation type multi-cylinder internal combustion engine.

A multi-cylinder engine equipped with a single carburetor normally has such a construction that the amount of air introduced into all of the cylinders of an engine is controlled by a single throttle valve of the carburetor. On the other hand, in the case wherein an engine is provided with a plurality of carburetors, the opening operation of a plurality of throttle valves each being mounted on the respective carburetor is simultaneously carried out in synchronization with each other. In such an engine equipped with a carburetor, when the opening degree of the throttle valve is small and the engine is thus operating under a light load, since a great loss of work (pumping loss) is caused at the time of the intake stroke, a specific fuel consumption is increased. On the other hand, this specific fuel consumption is gradually reduced as the opening degree of the throttle valve is increased. However, particularly in an engine for use in a road vehicle, since much of the operation of the engine is carried out under a partial load wherein the opening degree of the throttle valve is relatively small, a problem occurs in that the specific fuel comsumption is increased.

A split operation type engine, in which the cylinders are divided into two cylinder groups, has been proposed for eliminating the above-mentioned problem. In this split operation type engine, when the engine is operating under a light load, inert gas, such as air containing no fuel therein, is introduced into the cylinders of the second group without being throttled for minimizing the pumping loss; in addition, the cylinders of the first group are operated under a heavy load so that they can compensate the output power which would be generated from the cylinders of the second group if the firing operation of the cylinders of the second group were effected. As a result of this condition, the specific fuel consumption is improved for this split operation type engine. As a typical engine of this type, an engine has been proposed in which each of the intake throttle valves and the fuel supply devices is provided for the respective cylinder groups. In this engine, the throttle valves are mechanically interconnected to each other so that, when the opening degree of the throttle valve of the first cylinder group is increased beyond a predetermined opening degree, the opening operation of the throttle valve of the second cylinder group is started. In addition, a bypass passage is provided for directly communicating the intake passage of the second cylinder group with the atmosphere, and an air valve which is operated in response to vacuum changes in the intake passage of the first cylinder group is arranged in the bypass passage. When the engine is operating under a light load, the throttle valve of the second cylinder group is closed; in addition, the air valve is fully opened so that air is directly introduced into the cylinders of the second cylinder group from the atmosphere via the bypass passage. On the other hand, when the engine is operating under a heavy load, the throttle valve of the second cylinder group is opened; in addition, the air valve is closed for feeding an air-fuel mixture into the cylinders of the second cylinder group. In this engine, as is mentioned above, when the engine is operating under a light load, since air is fed into the cylinders of the second cylinder group from the bypass passage and then is discharged into the exhaust passage of the engine, the temperature of the exhaust gas in the exhaust passage is extremely reduced. As a result of this, there occurs a problem in that it is impossible to promote the oxidation of unburned HC and CO in the exhaust passage. In addition, in the case wherein the engine is provided with an exhaust gas purifier such as a catalytic converter, there also occurs a problem in that a satisfactory purifying operation of the exhaust gas cannot be obtained.

An object of the present invention is to provide a split operation type engine capable of preventing the reduction of temperature of the exhaust gas by recirculating the exhaust gas of a high temperature into the cylinders of the cylinder group in which the firing operation is not carried out.

According to the present invention, there is provided an internal combustion engine having a plurality of cyliders which are divided into a first cylinder group and a second cylinder group, said first cylinder group having a first intake passage and a first fuel supply means, said second cylinder group having a second intake passage and a second fuel supply means, said engine comprising: a first throttle valve arranged in said first intake passage for controlling an amount of a combustible mixture fed into said first cylinder group; a second throttle valve arranged in said second intake passage for normally closing said second intake passage to stop inflow of a combustible mixture into said second cylinder group; an exhaust passage connected to the cylinders of said first and second cylinder groups; a bypass passage communicating said exhaust passage with said second intake passage located downstream of said second throttle valve; valve means arranged in said bypass passage for normally allowing inflow of the exhaust gas into the cylinders of said second cylinder group, and; valve control means operatively connected to said first and second throttle valves and said valve means for increasing the opening degree of said first throttle valve in accordance with an increase in the level of a load of said engine and for closing said valve means and starting the opening operation of said second throttle valve to stop inflow of the exhaust gas and allow inflow of the combustible mixture into the cylinders of said second cylinder group when the load of said engine is increased beyond a predetermined level.

The present invention may be more fully understood from the following description of the preferred embodiment of the invention set forth below, together with the accompanying drawings.

DESCRIPTION OF A PREFERRED EMBODIMENT

Figure 1:
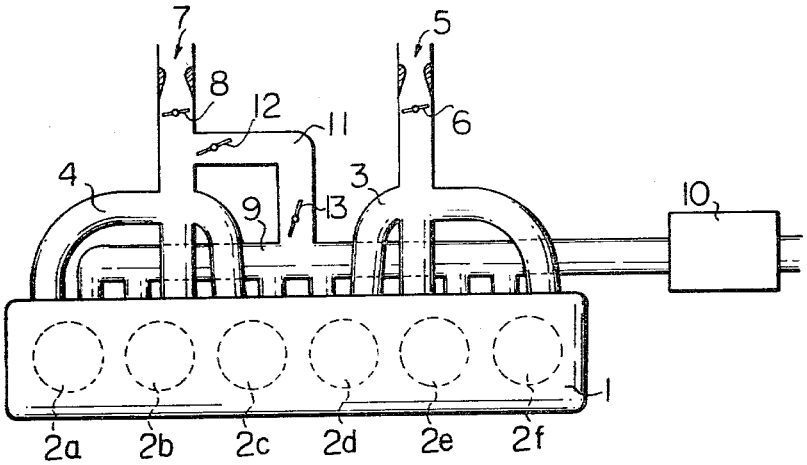
FIG. 1 is a schematic view of an engine according to the present invention.
Figure 2:
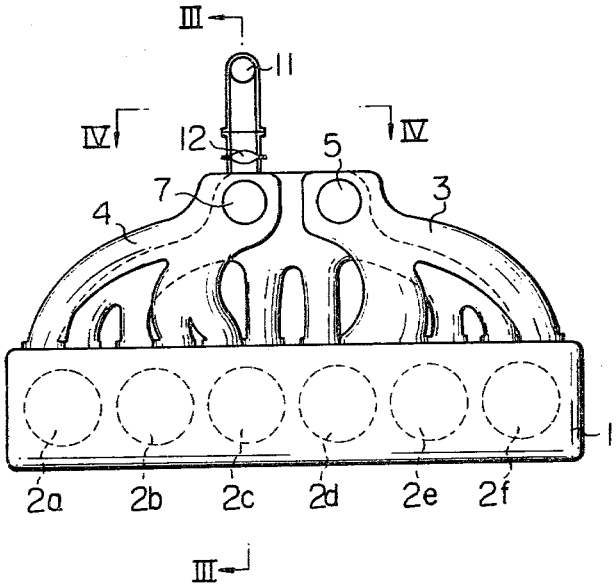
FIG. 2 is a plan view of an engine according to the present invention.
Figure 3:
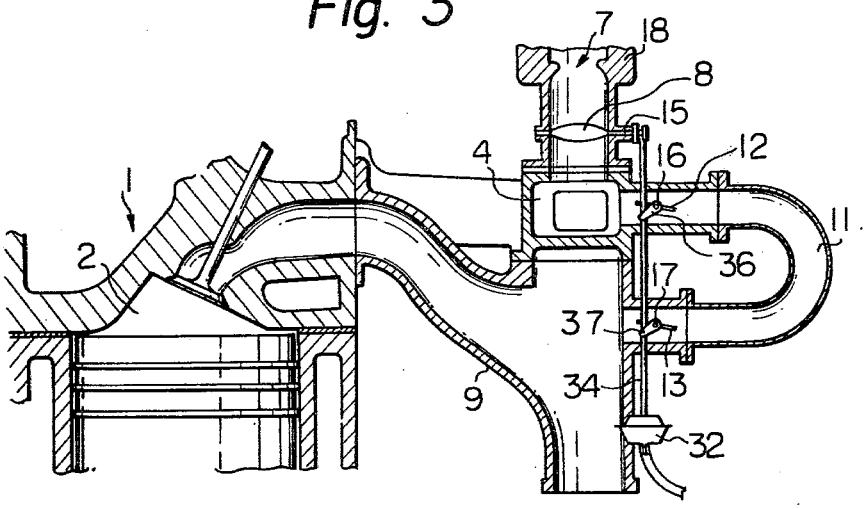
FIG. 3 is a cross-sectional view taken along the line III—III in FIG. 2.
Figure 5:
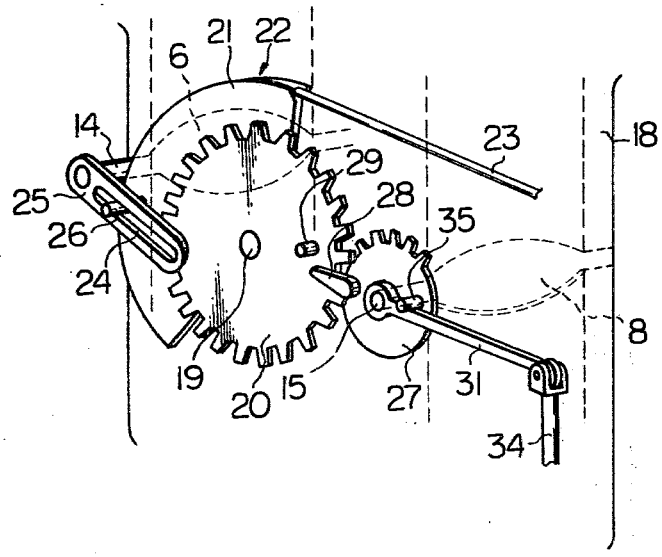
FIG. 5 is a perspective view of the intake device shown in FIG. 4.
Figure 4:
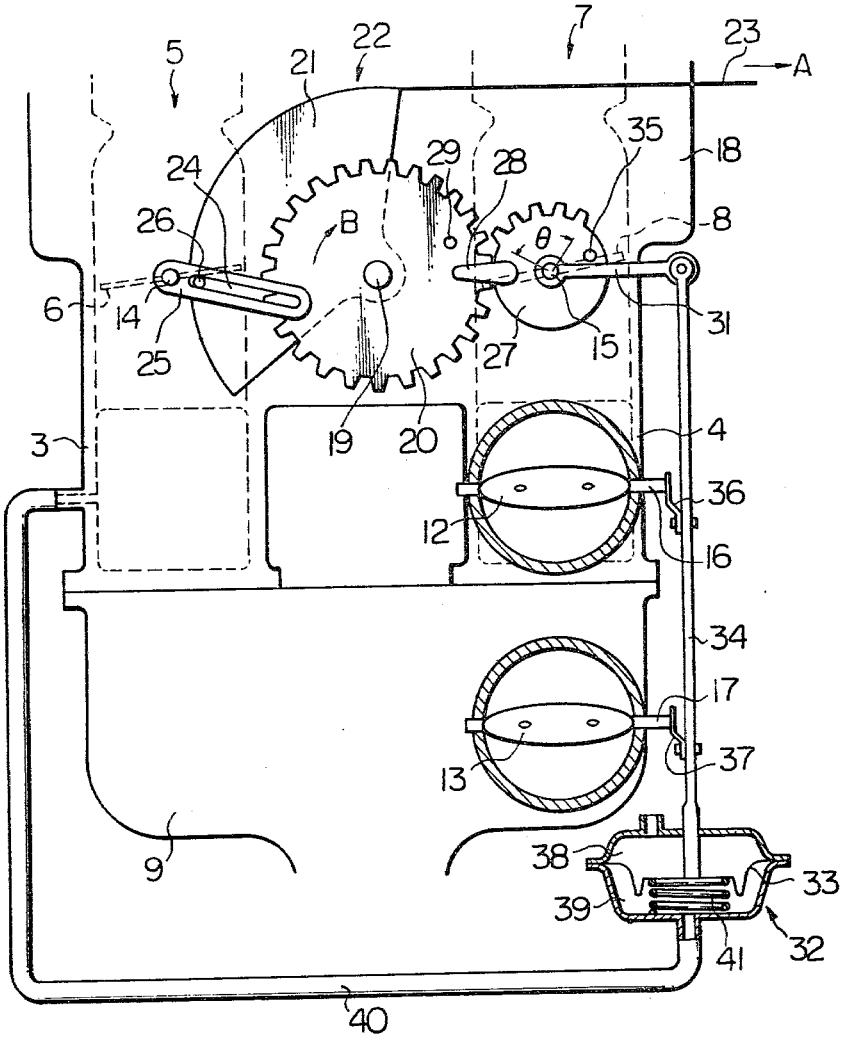
FIG. 4 is a side view of an intake device taken along the line IV—IV in FIG. 2.

FIG. 1 is a schematic view of an engine according to the present invention. Referring to FIG. 1, reference numeral 1 designates an engine body; *2a 2b, 2c, 2d, 2e, 2f* designate a cylinder, 3 a first intake manifold common to a first cylinder group of *2d, 2e, 2f;* 4 designates a second intake manifold common to a second cylinder group of *2a, 2b, 2c;* 5 designates a first carburetor, 6 a first throttle valve of the first carburetor 5; 7 designates a second carburetor, 8 a second throttle valve of the second carburetor 7; 9 designates an exhaust manifold common to the cylinders *2a, 2b, 2c, 2d, 2e* and *2f;* 10 designates an exhaust gas purifier such as a catalytic converter or a thermal reactor, 11 a bypass passage communicating the second intake manifold 4 located downstream of the second throttle valve 8 with the exhaust manifold 9 located upstream of the exhaust gas purifier 10; 12 designates a first exhaust valve arranged in the bypass passage 11 at a position near the second intake manifold 4, and; 13 designates a second exhaust valve arranged in the bypass passage 11 at a position near the exhaust manifold 9. FIGS. 2 and 3 are a plan view and a cross-sectional side view of an engine according to the present invention, respectively; FIG. 4 illustrates, an intake device of the engine illustrated in FIGS. 2 and 3, and; FIG. 5 is a perspective view of the intake device illustrated in FIG. 4. Referring to FIGS. 2 through 5, reference numeral 14 designates a throttle shaft of the first throttle valve 6; 15 designates a throttle shaft of the second throttle valve 8; 16 designates a valve shaft of the first exhaust valve 12; 17 designates a valve shaft of the second exhaust valve 13, and; 18 designates a carburetor housing including the first carburetor 5 and the second carburetor 7 therein. A pin 19 is fixed onto the carburetor housing 18, and a gear 20 is rotatably mounted on the pin 19. A pulley 21 is fixed onto the rear face of the gear 20, and a wire 23 connected to an accelerator pedal (not shown) is wound on a peripheral groove 22 formed on the pulley 21. Consequently, when the accelerator pedal is depressed and, accordingly, the wire 23 is pulled in the direction shown by the arrow A in FIG. 4, the gear 20 is rotated in the direction shown by the arrow B in FIG. 4 together with the pulley 21. On the other hand, a lever 25 forming a slit 24 thereon is fixed onto the throttle shaft 14 of the first throttle valve 6, and a pin 26 fixed onto the pulley 21 is fitted into the slit 24. Consequently, the first throttle valve 6 is opened as the pulley 21 is rotated in the direction of the arrow B. At this time, as is hereinafter described, the first throttle valve 6 is rapidly opened during the first half of the rotation of the pulley 21, and the first throttle valve 6 remains approximately fully open during the latter half of the rotation of the pulley 21.

As illustrated in FIG. 4, another gear 27 forming teeth on the outer pheriphery thereof, only within the range of an angle $\theta$, is fixed onto the throttle shaft 15 of the second throttle valve 8. The throttle shaft 15 is urged in the clockwise direction due to the spring force of the spring (not shown) so that the second throttle valve 8 is normally positioned at a closed position as illustrated in FIG. 4. In this position, the gear 27 remains disengaged from the gear 20. An arm 28 extending along the front face of the gear 20 is fixed onto the gear 27, and a pin 29 arranged to be engageable with the arm 28 is fixed onto the gear 20. When the gear 27 is rotated by an angle $\theta$ from the position shown in FIG. 4, the second throttle valve 8 is fully opened.

One end of a lever 31 is pivotably mounted on the throttle shaft 15 of the second throttle valve 8, and the other end of the lever 31 is connected to the tip of a control rod 34 which is fixed onto a diaphragm 33 of a vacuum-operated diaphragm apparatus 32. On the other hand, a pin 35 arranged to be engageable with the lever 31 is fixed onto the gear 27. In addition, the tips of arms 36 and 37, which are fixed onto the valve shafts 16 and 17 of first and second exhaust valves 12 and 13, respectively, are pivotably connected to the control rod 34. The diaphragm apparatus 32 comprises an atmospheric pressure chamber 38 and a vacuum chamber 39 which are separated by the diaphragm 33. The vacuum chamber 39 is connected via a vacuum conduit 40 to the first intake manifold 3 located at a position downstream of the first throttle valve 6. In addition, a compression spring 41 is inserted into the vacuum chamber 39 for always biasing the diaphragm 33 towards the atmospheric pressure chamber 38.

FIG. 4 illustrates the case wherein an engine is operating under an idling condition. When the accelerator pedal (not shown) is depressed and, accordingly, the pulley 21 is rotated in the direction of the arrow B, the first throttle valve 6 is opened. At this time, as illustrated in FIG. 4, the second throttle valve 8 remains completely closed, and the first exhaust valve 12 and the second exhaust valve 13 remain fully opened. Consequently, the firing operation is carried out in the first cylinder group of *2d, 2e, 2f* and, on the other hand, the exhaust gas is recirculated into the second cylinder group of *2a, 2b, 2c* via the bypass passage 11 and the second intake manifold 4. Consequently, at this time, the firing operation is not carried out in the second cylinder group of *2a, 2b, 2c.* In this case, since the recirculated exhaust gas of a high temperature is discharged into the exhaust manifold 9 from the second cylinder group of *2a, 2b, 2c,* the exhaust gas in the exhaust manifold 9 is maintained at a high temperature. Thus, a satisfactory purifying operation of the exhaust gas in the exhaust manifold 9 and the exhaust gas purifier 10 can be ensured. The level of the vacuum produced in the first intake manifold 3 located at a position downstream of the first throttle valve 6 is gradually reduced as the opening degree of the first throttle valve 6 is increased. When vacuum in the first intake manifold 3 becomes equal to a predetermined set level, the diaphragm 33 of the diaphragm apparatus 32 moves upwards due to the spring force of the compression spring 41. As a result of this, the first exhaust valve 12 and the second exhaust valve 13 is rotated to be completely closed and, at the same time, since the lever 31 pushes the pin 35 upwards, the gear 27 is rotated in the counterclockwise direction, whereby the teeth of the gear 27 come into engagement with the teeth of the gear 20. After this, when the accelerator pedal is further depressed and, accordingly, the gear 20 is rotated in the direction of the arrow B, the gear 27 is rotated in the counterclockwise direction by the gear 20 and, as a reuslt, the second throttle valve 8 is gradually opened. Consequently, the firing operation of the engine is started in the second cylinder group of 2a, 2b, 2c. When the second throttle valve 8 is rotated by an angle $\theta$ from its closed position to become fully opened, opened, the gear 27 is disengaged from the gear 20. Consequently, after this, even if the gear 20 is further rotated, the gear 27 remains stopped and the second throttle valve 8 remains fully opened.

Figure 6:
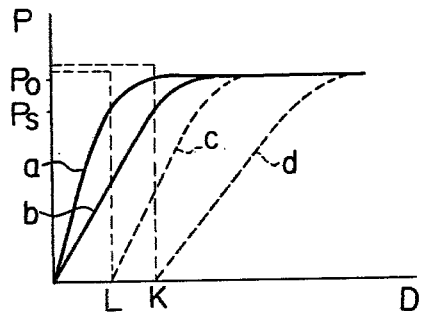
FIG. 6 is a graph showing the relationship between the depression of the accelerator pedal and the vacuum produced in the intake manifold.
Figure 7:
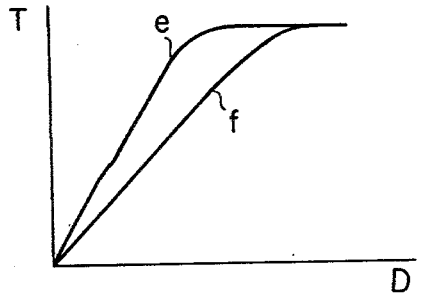
FIG. 7 is a graph showing the relationship between the depression of the accelerator pedal and the output torque of an engine.

FIG. 6 illustrates the relationship between the depression of the accelerator pedal and the level of the vacuum in the intake manifold, and FIG. 7 illustrates the relationship between the depression of the accelerator pedal and the output torque of the engine. In FIG. 6, the abscissa indicates the depression D of the accelerator pedal, and the ordinate indicates the level of the absolute pressure P in the intake manifold. In addition, in FIG. 6, Po of the ordinate indicates the atmospheric pressure, and Ps of the ordinate indicates a predetermined set vacuum level at which the diaphragm begins to move upwards due to the spring force of the compression spring. On the other hand, in FIG. 7, the abscissa indicates the depression D of the accelerator pedal, and the ordinate indicates the output torque T of an engine. In FIG. 6, the curved line a indicates the vacuum level produced in the first intake manifold when the engine is operating at a low speed; the curved line b indicates the vacuum level produced in the first intake manifold when the engine is operating at a high speed; the curved line c indicates the vacuum level produced in the second intake manifold when the engine is operating at a low speed; and the curved line d indicates the vacuum level produced in the second intake manifold when the engine is operating at a high speed. On the other hand, in FIG. 7, the curved line e indicates the output torque of the engine when the engine is operating at a low speed, and the curved line f of indicates the output torque of the engine when the engine is operating at a high speed.

In FIG. 6, the pressure in the first intake manifold becomes approximately equal to the atmospheric pressure Po when the first throttle valve is fully opend. Consequently, from FIG. 6, it will be understood that the first throttle valve is rapidly opened during the first half of the depression of the accelerator pedal, and the first throttle valve remains approximately fully open during the latter half of the depression of the acceleration pedal. In addition, from FIG. 6, it will be understood that the depression D of the accelerator pedal, that is, the opening degree of the first throttle valve, in which the vacuum corresponding to the predetermined set level Ps is produced in the first intake manifold, is increased as the speed of the engine is increased.

As is mentioned previously, a conventional engine is so constructed that the opening operation of the second throttle valve is started when the depression D of the accelerator pedal becomes equal to, for example, the depression indicated by K in FIG. 6. Consequently, when the engine is operating at a high speed as shown by the curved line b, no problem occurs because the opening operation of the second throttle valve is started at the same time that the air valve arranged in the bypass passage is closed. However, when the engine is operating at a low speed as indicated by the curved line a in FIG. 6, the air valve is closed when the depression D of the accelerator pedal is increased beyond the depression shown by L in FIG. 6. Consequently, since both the second throttle valve and the air valve remain closed when the depression D of the accelerator pedal is within the range of between L and K shown in FIG. 6, the intake throttling loss is considerably increased in the second intake manifold and, as a result, the output torque of the engine is reduced. However, in the present invention, since the opening operation of the second throttle valve 8 is always carried out in synchronization with the closing operation of the first and second exhaust valves 12 and 13 independent of the speed of the engine, a smooth increase in the output torque of the engine can be ensured, independent of the speed of the engine, as illustrated in FIG. 7.

In the embodiment illustrated in FIGS. 4 and 5, there is a danger that, when the accelerator pedal is rapidly depressed, the gear 27 cannot come into appropriate engagement with the gear 20 due to presence of a time lag in the operation of the diaphragm apparatus 32. In order to avoid occurrence of this danger, the arm 28 and the pin 29 are provided in the present invention. That is, when the accelerator pedal is rapidly depressed, the pin 29 causes the arm 28 to move downward, whereby the gear 27 can come into engagement with the gear 20. However, the gear 27 normally comes into engagement with the gear 20 by means of the diaphragm apparatus 32 before the pin 29 abuts against the arm 28.

As is illustrated in FIGS. 3 and 4, a pair of the exhaust valves 12, 13 is arranged in the bypass passage 11. However, either of the first exhaust valve 12 or the second exhaust valve 13 can be removed. Nevertheless, in the case wherein only a single exhaust valve is arranged in the bypass passage 11, since the single exhaust valve is always exposed to the exhaust gas having a high temperature, the life time of the exhaust valve is shortened. Consequently, when the exhaust valve is used for a long time, it is difficult to prevent the exhaust gas from leaking into the second intake manifold. Therefore, as is illustrated in FIGS. 4 and 5, it is preferable that a pair of the exhaust valves 12, 13 be arranged in the bypass passage 11. That is, by arranging a pair of the exhaust valves 12, 13 in the bypass passage 11, since the first exhaust valve 12 is not directly exposed to the exhaust gas having a high temperature when the second exhaust valve 13 is closed, the life time of the first exhaust valve 12 can be improved. As a result of this, the function of preventing the leakage of the exhaust gas can be ensured for a long time.

According to the present invention, since the exhaust gas having a high temperature is recirculated into the cylinders of the second cylinder group when an engine is operating under a light load, the exhaust gas in the exhaust manifold and the exhaust gas purifier is maintained at a high temperature. This results in ensuring a good purifying operation of the exhaust gas. In addition, in the embodiment illustrated in FIG. 1, only the exhaust gas is fed into the cylinders of the secohd cylinder group when the firing operation is not carried out in the second cylinder group. However, in the case wherein the temperature of the exhaust gas is excessively increased by feeding only the exhaust gas into the cylinders of the second cylinder group, the mixture of the exhaust gas and an ambient air may be fed into the cylinders of the second cylinder group. Furthermore, when the firing operation is carried out in the second cylinder group, the exhaust valves 12, 13 may remain slightly opened to feed a small amount of the exhaust gas into the cylinders of the second cylinder group for reducing the amount of harmful $NO_x$ components produced in the cylinders of the second cylinder group.

Although the invention has been described above with reference to a specific embodiment chosen for purposes of illustration, it should be apparent that numerous modifications could be made thereto by those skilled in the art without departing from the spirit and scope of the invention.

What is claimed is:

1. An internal combustion engine having a plurality of cylinders which are divided into a first cylinder group and a second cylinder group, said first cylinder group having a first intake passage and a first fuel supply means, said second cylinder group having a second intake passage and a second fuel supply means, said engine comprising:

a first throttle valve arranged in said first intake passage for controlling an amount of a combustible mixture fed into said first cylinder group;

a second throttle valve arranged in said second intake passage for normally closing said second intake passage to stop inflow of a combustible mixture into said second cylinder group;

an exhaust passage connected to the cylinders of said first and second cylinder groups;

a bypass passage communicating said exhaust passage with said second intake passage located downstream of said second throttle valve;

valve means arranged in said bypass passage for normally allowing inflow of the exhaust gas into the cylinders of said second cylinder group, and;

valve control means operatively connected to said first and second throttle valves and said valve means for increasing the opening degree of said first throttle valve in accordance with an increase in the level of a load of said engine and for closing said valve means and starting the opening operation of said second throttle valve to stop inflow of the exhaust gas and allow inflow of the combustible mixture into the cylinders of said second cylinder group when the load of said engine is increased beyond a predetermined level.

2. An internal combustion engine as claimed in claim 1, wherein said valve control means comprises valve actuating means operatively connected to said first throttle valve for increasing the opening degree of said first throttle valve in accordance with an increase in the level of a load of said engine and intermittently connected to said second throttle valve for increasing the opening degree of said second throttle valve in accordance with an increase in the level of the load of said engine when said second throttle valve is connected to said valve actuating means, and vacuum-operated control means for establishing mechanical connection between said valve actuating means and said second throttle valve to allow inflow of the combustible mixture into said second cylinder group and for causing the closing operation of said valve means to stop inflow of the exhaust gas into said second cylinder group when the level of the vacuum produced in said first intake passage is reduced below a predetermined level.

3. An internal combustion engine as claimed in claim 2, wherein said valve actuating means comprises a first rotary member operatively connected to said first throttle valve and rotated in accordance with an increase in the level of the load of said engine, and a second rotary member connected to said second throttle valve and arranged to be engageable with said first rotary member, said second rotary member remaining disengaged from said first rotary member when the level of the vacuum produced in said first intake passage is greater than said predetermined level, while said vacuum-operated control means causes said second rotary member to come into engagement with said first rotary member when the level of the vacuum produced in said first intake passage is reduced below said predetermined level.

4. An internal combustion engine as claimed in claim 3, wherein said first rotary member comprises a first gear, and said second rotary member comprises a second gear.

5. An internal combustion engine as claimed in claim 4, wherein said second gear has teeth which are partially formed along an outer periphery of said second gear.

6. An internal combustion engine as claimed in claim 3, wherein said vacuum-operated control means comprises a diaphragm apparatus having a vacuum chamber which is defined by a diaphragm, said vacuum chamber being connected to said first intake passage, said diaphragm being connected to said valve means and operatively connected to said second rotary member.

7. An internal combustion engine as claimed in claim 6, wherein said diaphragm has a rod extending therefrom, said rod being connected to a lever which is arranged to be rotatable about an axis of said second rotary member, said second rotary member having thereon a pin which is arranged to be engageable with said lever, the engagement of said lever and said pin causing said first rotary member and said second rotary member to come into engagement with each other.

8. An internal combustion engine as claimed in claim 2, wherein said valve control means comprises connecting means for establishing a mechanical connection between said valve actuating means and said second throttle valve, independent of the level of the vacuum produced in said first throttle valve, when the level of the load of the engine is rapidly increased.

9. An internal combustion engine as claimed in claim 8, wherein said valve control means further comprises a first gear operatively connected to said first throttle valve and rotated in accordance with an increase in the level of the load of the engine, and second gear connected to said second throttle valve and arranged to be engageable with said first gear, said connecting means causing said first gear and said second gear to engage with each other when said first gear is rapidly rotated.

10. An internal combustion engine as claimed in claim 9, wherein said connecting means comprises a pin mounted on said first gear, and an arm mounted on said second gear and arranged to be engageable with said pin of the first gear.

11. An internal combustion engine as claimed in claim 1, wherein said valve control means comprises a rotary member rotated in accordance with an increase in the level of the load of said engine, and link means interconnecting said rotary member with said first throttle valve for rapidly opening said first rhrottle valve during the first half of the rotation of said rotary member and for causing said first throttle valve to remain fully open during the latter half of the rotation of said rotary member.

12. An internal combustion engine as claimed in claim 11, wherein said link means comprises a lever connected to said first throttle valve and having a slit, and a pin mounted on said rotary member and fitted into said slit of the lever connected to said first throttle valve.

13. An internal combustion engine as claimed in claim 1, wherein said valve means comprises a pair of valves which are actuated in synchronization with each other.

* * * * *

UNITED STATES PATENT AND TRADEMARK OFFICE

CERTIFICATE OF CORRECTION

PATENT NO. : 4,198,940

DATED : April 22, 1980

INVENTOR(S) : Yasuhiko Ishida

It is certified that error appears in the above—identified patent and that said Letters Patent is hereby corrected as shown below:

Col. 2, line 22, correct spelling of "cylinders".

Col. 3, line 12, after "2a" insert -- , --.

Col. 3, line 64, correct spelling of "periphery".

Col. 4, line 66, correct spelling of "result".

Col. 5, line 3, delete second occurrence of "opened,".

Col. 5, line 34, after "f" delete --of--.

Col. 5, line 39, correct spelling of "opened".

Col. 6, line 53, correct spelling of "second".

Col. 8, line 55, correct spelling of "throttle".

Signed and Sealed this

*Ninth* Day of *September 1980*

[SEAL]

*Attest:*

SIDNEY A. DIAMOND

*Attesting Officer*

*Commissioner of Patents and Trademarks*